US007628461B2

(12) United States Patent
Carden et al.

(10) Patent No.: US 7,628,461 B2
(45) Date of Patent: Dec. 8, 2009

(54) BOTTOM MOUNT REFRIGERATOR HAVING AN ELEVATING FREEZER BASKET

(75) Inventors: Michael Scot Carden, Williamsburg, IA (US); Kurt C. Senner, Galesburg, IL (US)

(73) Assignee: Maytag Corporation, Benton Harbor, MI (US)

( * ) Notice: Subject to any disclaimer, the term of this patent is extended or adjusted under 35 U.S.C. 154(b) by 349 days.

(21) Appl. No.: 11/489,450

(22) Filed: Jul. 20, 2006

(65) Prior Publication Data

US 2008/0018215 A1 Jan. 24, 2008

(51) Int. Cl.
*A47B 88/00* (2006.01)

(52) U.S. Cl. ..... 312/402; 312/310

(58) Field of Classification Search ..... 312/404, 312/408, 402, 291, 301, 311, 310; 108/145
See application file for complete search history.

(56) References Cited

U.S. PATENT DOCUMENTS

| | | | | | |
|---|---|---|---|---|---|
| 1,934,370 | A | * | 11/1933 | Mirabella | 312/266 |
| 2,486,564 | A | * | 11/1949 | Kamin | 126/41 E |
| 2,525,201 | A | * | 10/1950 | Beynon et al. | 126/340 |
| 2,590,341 | A | * | 3/1952 | Nabholz | 312/266 |
| 2,819,141 | A | * | 1/1958 | Myer | 312/303 |
| 3,212,835 | A | * | 10/1965 | Beckett et al. | 312/311 |
| 3,862,788 | A | * | 1/1975 | Hock et al. | 312/294 |
| 4,151,804 | A | * | 5/1979 | Wache et al. | 108/147 |
| 4,790,146 | A | | 12/1988 | Mun et al. | |
| 5,908,009 | A | | 6/1999 | Cummings | |
| 5,971,513 | A | * | 10/1999 | Cassalia | 312/310 |
| 6,247,771 | B1 | * | 6/2001 | Miller | 312/310 |
| 6,641,239 | B2 | * | 11/2003 | Kaiser | 312/404 |
| 7,232,196 | B2 | | 6/2007 | Kwon et al. | |
| 7,396,093 | B2 | * | 7/2008 | Jeong et al. | 312/402 |
| 2004/0164654 | A1 | * | 8/2004 | Laible | 312/122 |
| 2004/0183415 | A1 | * | 9/2004 | Kim | 312/402 |
| 2006/0022564 | A1 | * | 2/2006 | Oh et al. | 312/402 |
| 2006/0043848 | A1 | | 3/2006 | Jeong et al. | |
| 2006/0043849 | A1 | | 3/2006 | Oh et al. | |
| 2006/0049731 | A1 | | 3/2006 | Choi et al. | |

FOREIGN PATENT DOCUMENTS

| | | | |
|---|---|---|---|
| JP | 5-296647 | * | 11/1993 |
| JP | 2002264943 | | 8/2002 |
| JP | 2002264943 | A | 9/2002 |

* cited by examiner

*Primary Examiner*—Janet M Wilkens
(74) *Attorney, Agent, or Firm*—Kirk W. Goodwin; Diederiks & Whitelaw PLC

(57) ABSTRACT

A refrigerator includes a cabinet within which is arranged an upper fresh food compartment and a lower freezer compartment. A freezer basket is slidingly supported in the freezer compartment, preferably for concurrent movement with a freezer door. The freezer basket is coupled to a lifting mechanism that selectively shifts the freezer basket from a first or lowered position to a second or raised position in order to facilitate removal of items from the freezer basket. The lifting mechanism can be formed by a mechanical, electrical or pneumatic system.

7 Claims, 7 Drawing Sheets

BOTTOM MOUNT REFRIGERATOR HAVING AN ELEVATING FREEZER BASKET

BACKGROUND OF THE INVENTION

1. Field of the Invention

The present invention pertains to the art of refrigerators and, more particularly, to an elevating freezer basket for a bottom mount refrigerator.

2. Discussion of the Prior Art

There are a number of refrigerator models available for today's consumers. Generally speaking, refrigerators are available in side-by side, top mount and bottom mount models. In side-by-side refrigerator models, fresh food and freezer compartments are arranged laterally adjacent one another. In top mount models, the freezer compartment is arranged above the fresh food compartment. Conversely, in bottom mount models, the freezer compartment is arranged below the fresh food compartment.

In general, top mount and bottom mount models provide more storage options than corresponding side-by-side models. That is, while a side-by-side refrigerator is generally wider then top and bottom mount models, the fresh food and freezer compartments are typically narrower than corresponding compartments in top and/or bottom mount models. Thus, larger or, more specifically, wider items such as pizza boxes, baking trays and platters are often more readily accommodated in top and bottom mount models.

Of course, top and bottom mount models also possess certain drawbacks. For instance, in top mount models, accessing lower portions of the fresh food compartment requires considerable bending on behalf of the consumer. For certain consumers, bending may often times be difficult. Likewise, in bottom mount models, accessing a lower freezer basket requires a certain amount of bending. Still, given the size and depth of a freezer basket in a typical bottom mount refrigerator, accessing the freezer basket often times requires significant bending which can outweigh the benefits. However, since the fresh food compartment is typically accessed multiple times more than the freezer compartment, a bottom mount refrigerator, which places essentially the entire fresh food compartment at a conveniently accessible height, has many benefits.

Based on the above, there exists a need in the art for a bottom mount refrigerator having an accessible freezer compartment. More specifically, there exists a need for a mechanism that elevates a freezer basket in a bottom mount refrigerator to facilitate access to items stored therein.

SUMMARY OF THE INVENTION

The present invention is generally directed to a bottom mount refrigerator having a cabinet shell within which is positioned a liner that defines a fresh food compartment. A fresh food door is pivotally mounted relative to the cabinet shell to selectively provide access to the fresh food compartment. A freezer compartment is arranged below the fresh food compartment and is provided with a corresponding freezer door. The freezer door is shiftably mounted relative to the cabinet to selectively provide access to the freezer compartment.

In accordance with the invention, the refrigerator includes a freezer basket and a second, or upper, slidingly basket supported in the freezer compartment. Actually, the lower freezer basket is operatively connected to the freezer door such that accessing the freezer compartment causes the basket to shift outward. The lower freezer basket is coupled to a lifting mechanism that shifts the lower freezer basket from a first or lowered position to a second or raised position in order to facilitate the removal of any items stored therein. More specifically, if a consumer wishes to access the freezer basket without bending, the lifting mechanism is operated so as to raise the lower freezer basket, preferably to a height corresponding to the upper freezer basket. In accordance with the invention, various mechanisms can be employed to achieve the desired lifting. For example, the lifting mechanism can be formed by a mechanical system such as a linkage system, an electrical system such as a worm screw arrangement, or a pneumatic system which employs a gas assist cylinder.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
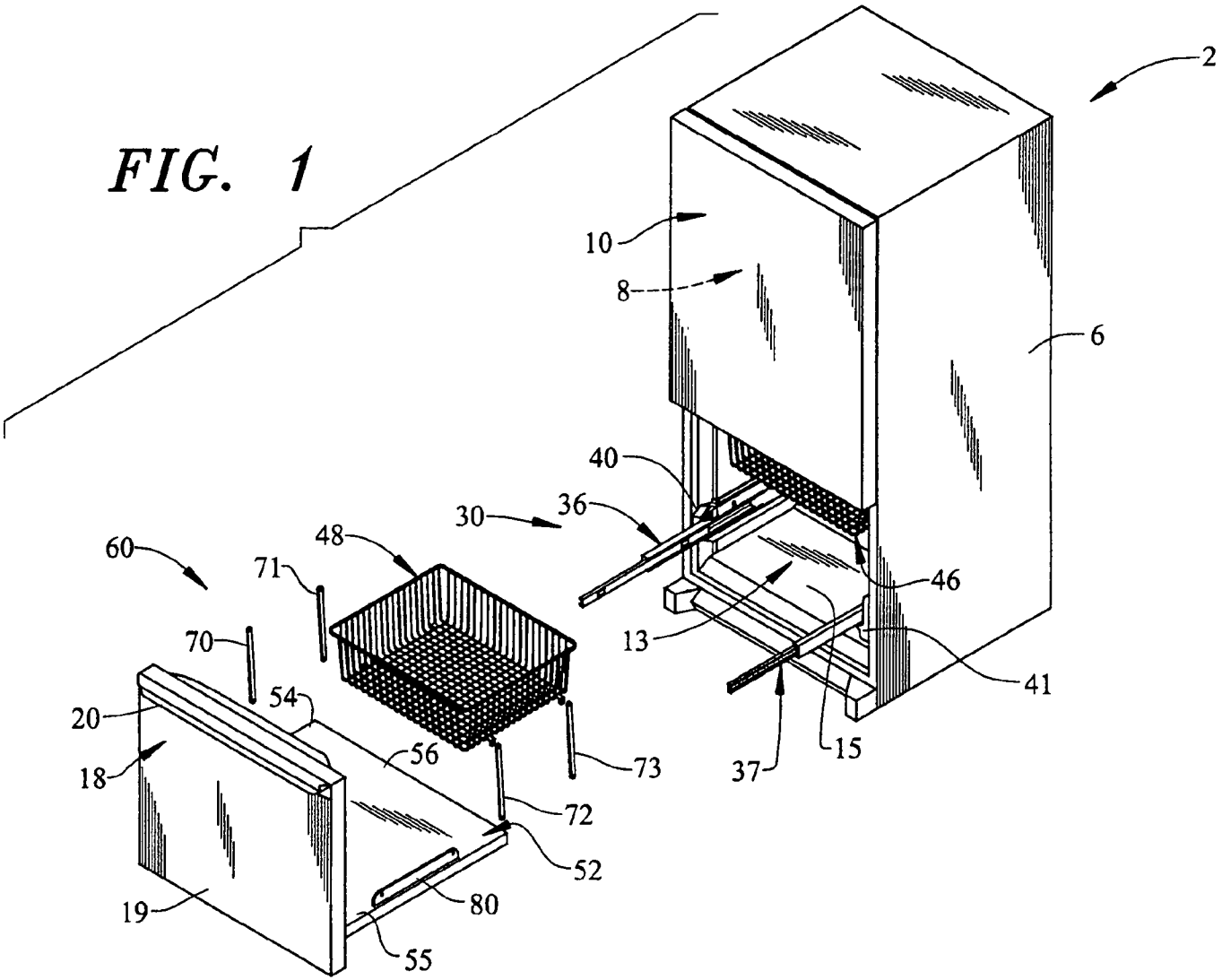
FIG. 1 is a partially exploded, perspective view of a bottom mount refrigerator incorporating an elevating freezer basket constructed in accordance with a first embodiment of the present invention.
Figure 2:
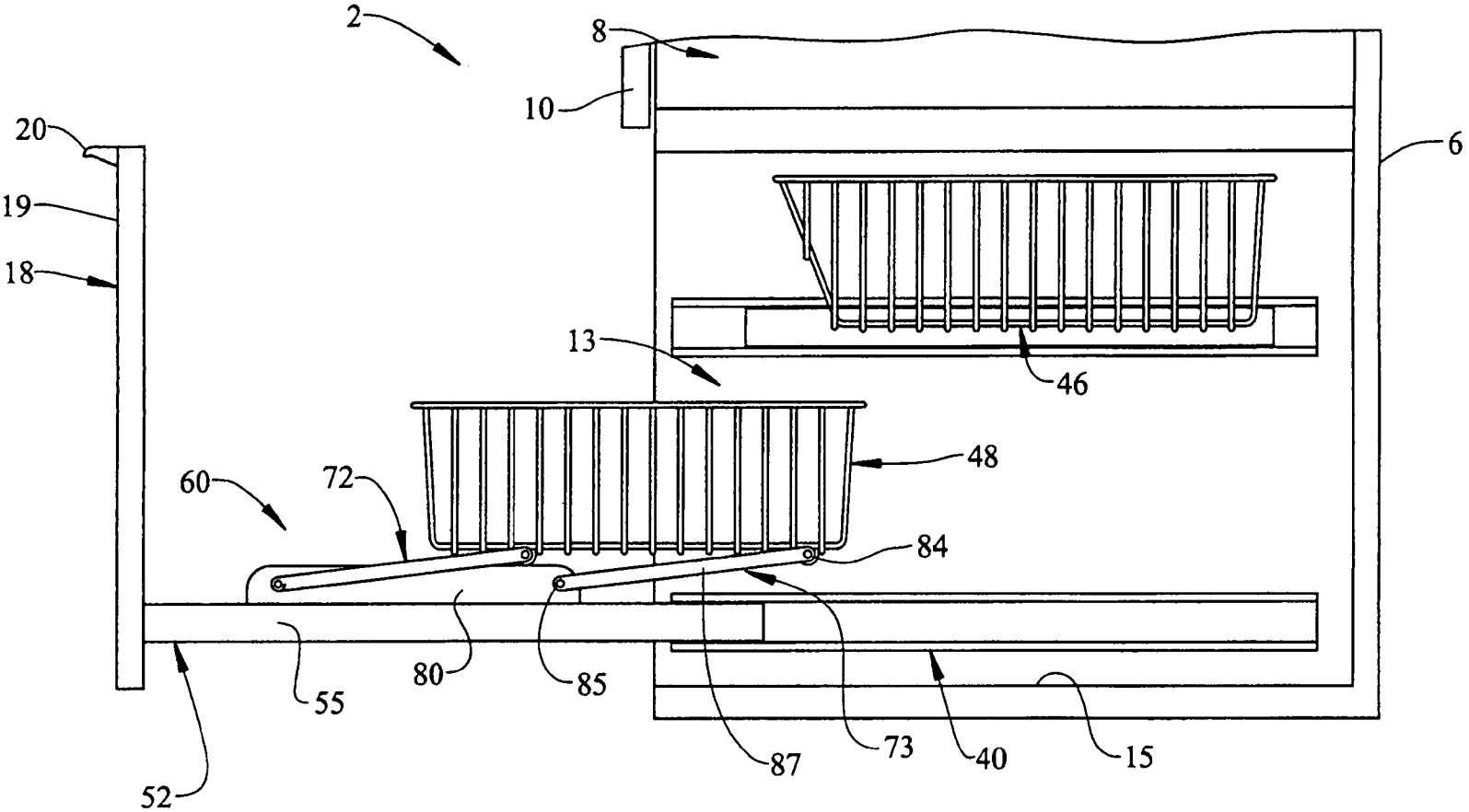
FIG. 2 is a cut-away side view of the refrigerator of FIG. 1 illustrating the elevating freezer basket in a first or lowered position.
Figure 3:
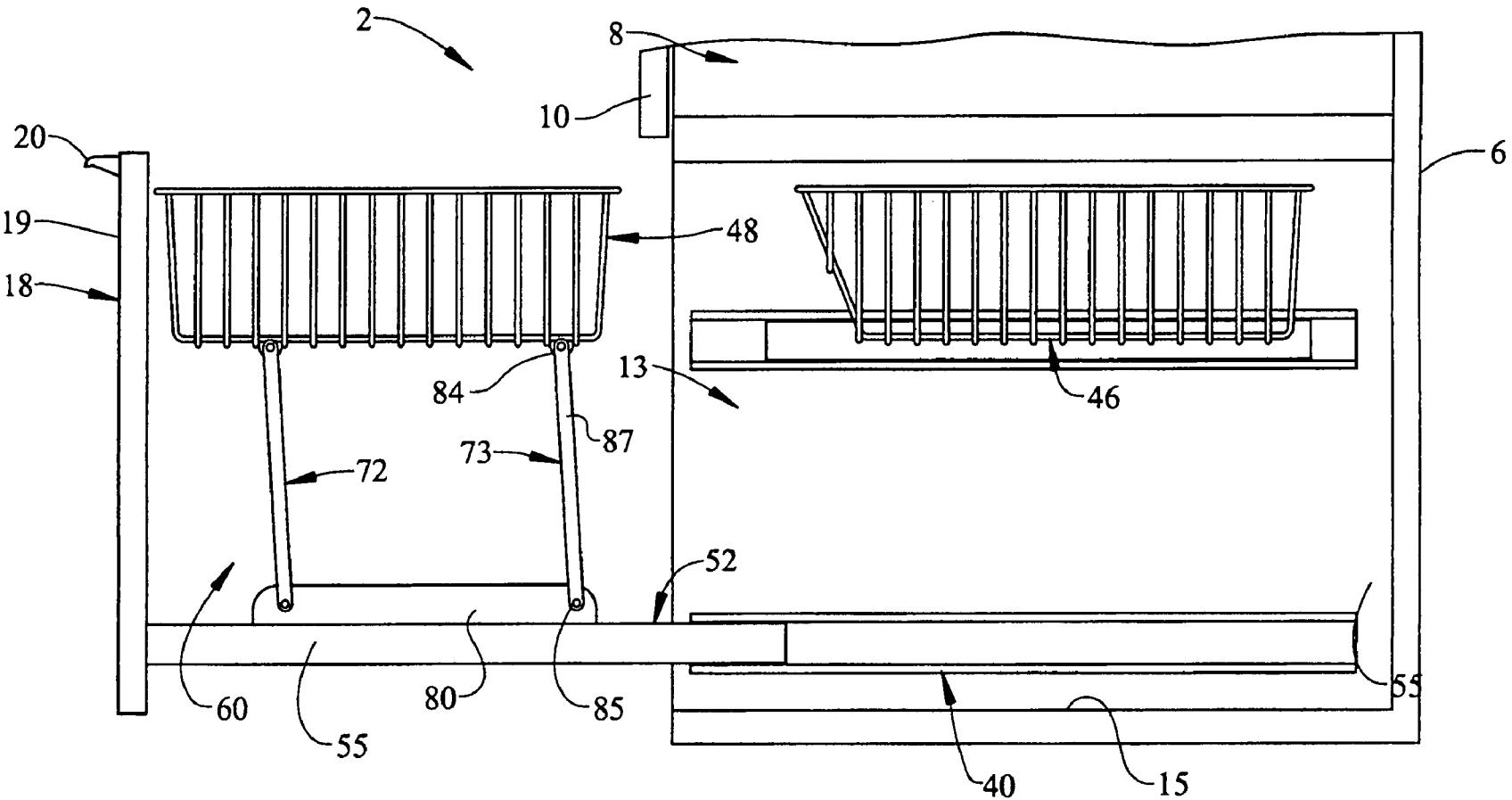
FIG. 3 is a cut-away side view of the refrigerator of FIG. 1 illustrating the elevating freezer basket in a second or raised position.

With initial reference to FIGS. 1-3, a refrigerator constructed in accordance with the present invention is generally indicated at 2. Refrigerator 2 includes a cabinet shell 6 within which is defined a fresh food compartment 8. A fresh food compartment door 10 is pivotally mounted relative to cabinet shell 6 so as to selectively provide access to fresh food compartment 8. In accordance with the invention, a freezer compartment 13 is arranged below fresh food compartment 8. With this arrangement, refrigerator 2 actually constitutes a bottom mount model. In a manner known in the art, freezer compartment 13 includes a liner 15 and a freezer compartment door 18. In accordance with the invention, freezer compartment door 18 is shiftably mounted relative to cabinet shell 6 and is shown to include a main or outer body portion 19 to which is attached a handle 20. Handle 20, in a manner known in the art, enables a consumer to grasp and shift freezer compartment door 18 outwardly, thereby exposing and providing access to freezer compartment 13.

In the embodiment shown, freezer compartment door 18 is suspended by a drawer support system 30 that includes a pair of extensible drawer support glides 36 and 37 which are mounted to a corresponding pair of glide receivers 40 and 41 formed on opposing side walls (not separately labeled) of liner 15. In order to provide flexible storage options for a consumer, freezer compartment 13 includes a first or upper basket 46 which is slidably supported on opposing side walls of liner 15 in a manner similar to that described for freezer compartment door 18, and a second or lower basket 48 that is, in a manner that will discussed more fully below, shiftably supported upon freezer compartment door 18. More specifically, lower basket 48 is shiftably supported by a lower or basket support wall 52 that extends from main portion 19 of freezer door 18. Actually, as best shown in FIG. 2, basket support wall 52 extends substantially perpendicularly from a lower region (not separately labeled) of main portion 19. In order to allow a consumer to easily retrieve articles from lower basket 48, i.e., retrieve articles without having to significantly bend or reach into lower portions of freezer compartment 13, lower basket 48 is mounted to a lifting mechanism 60 that is selectively operated to raise lower basket 48 to a level that is substantially co-planar with upper basket 46.

In accordance with a first embodiment of the present invention, lifting mechanism 60 includes a plurality of lifting members 70-73 that are pivotally attached to a pair of base members, one of which is indicated at 80. That is, lifting members 72 and 73 are pivotally secured to base member 80, while lifting members 70 and 71 are secured to a corresponding opposing base member (not shown). Base member 80 and the opposing base member (not shown) are arranged on side portions 54 and 55 of basket support wall 52 with lower basket 48 being arranged therebetween. In any event, as each lifting member 70-73 is constructed similarly, a detailed description will be made with respect to lifting member 73 with an understanding that lifting members 70-72 are substantially identical.

As best shown in FIGS. 2 and 3, lifting member 73 includes a first end portion 84 that is pivotally connected to basket 48 and that extends to a second end portion 85 through an intermediate portion 87. Second end portion 85 is, in accordance with the invention, pivotally connected to base member 80. Lifting member 73 is designed to provide, in accordance with the most preferred form of the invention, approximately 12-inches (30.5 cm) of lift to lower basket 48. More specifically, when operated, lifting mechanism 60 raises lower basket 48, approximately 12-inches (30.5 cm), so as to be substantially co-planar with upper basket 46 in a manner that will become more fully evident below.

When initially opening freezer door 18, lower basket 48 shifts outward and is in a first or lowered position so as to be orientated below upper basket 46 as represented in FIG. 2. In the lowered position, freezer door 18 can be readily shifted out from freezer compartment 13 without lower freezer basket 48 interfering with upper freezer basket 46. Unfortunately, retrieving objects from lower basket 48 when in the lowered position can be difficult for some consumers. In order to make the retrieval of objects easier, a consumer need simply grasp a front edge portion (not separately labeled) of lower basket 48 and pull upward towards freezer compartment door 8 thereby shifting lower basket 48 to a second or raised position as represented in FIG. 3. More specifically, as the consumer pulls on lower basket 48, lifting members 70-73 pivot about base member 80 to guide lower basket 48 along an arcuate path until reaching a fully raised position wherein lifting members 70-73 are in an over-center position which retains lower basket 48 in the raised position. Once in the fully raised position, a consumer can easily remove the desired items from lower basket 48. After removing the desired items, the consumer need simply guide lower basket 48 back along the arcuate path to return lower basket 48 to the lowered position and thereafter close freezer door 18.

Figure 4:
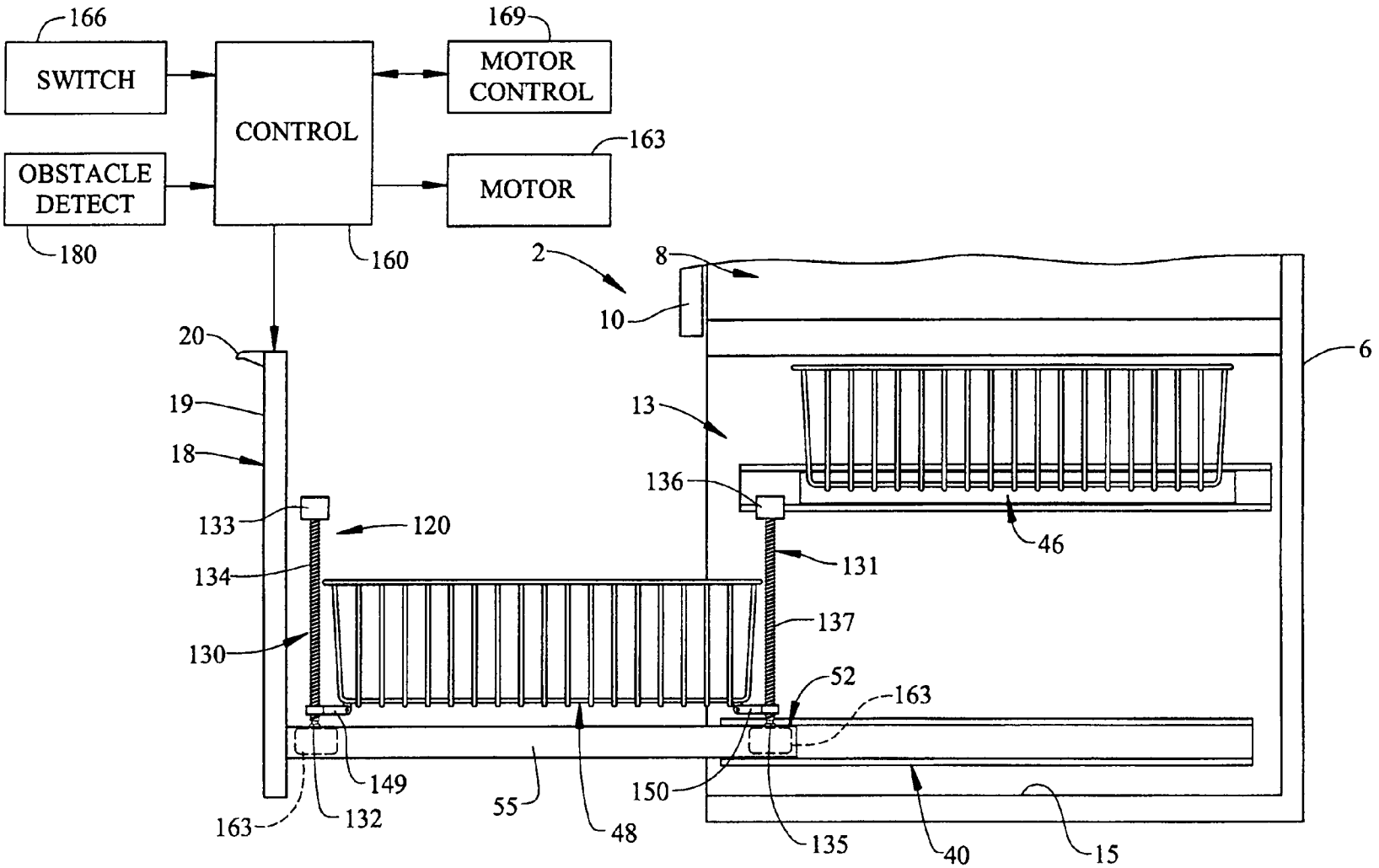
FIG. 4 is a cut-away side view of a refrigerator incorporating an elevating freezer basket constructed in accordance with a second embodiment of the present invention, with the freezer basket in a first or lowered position.
Figure 5:
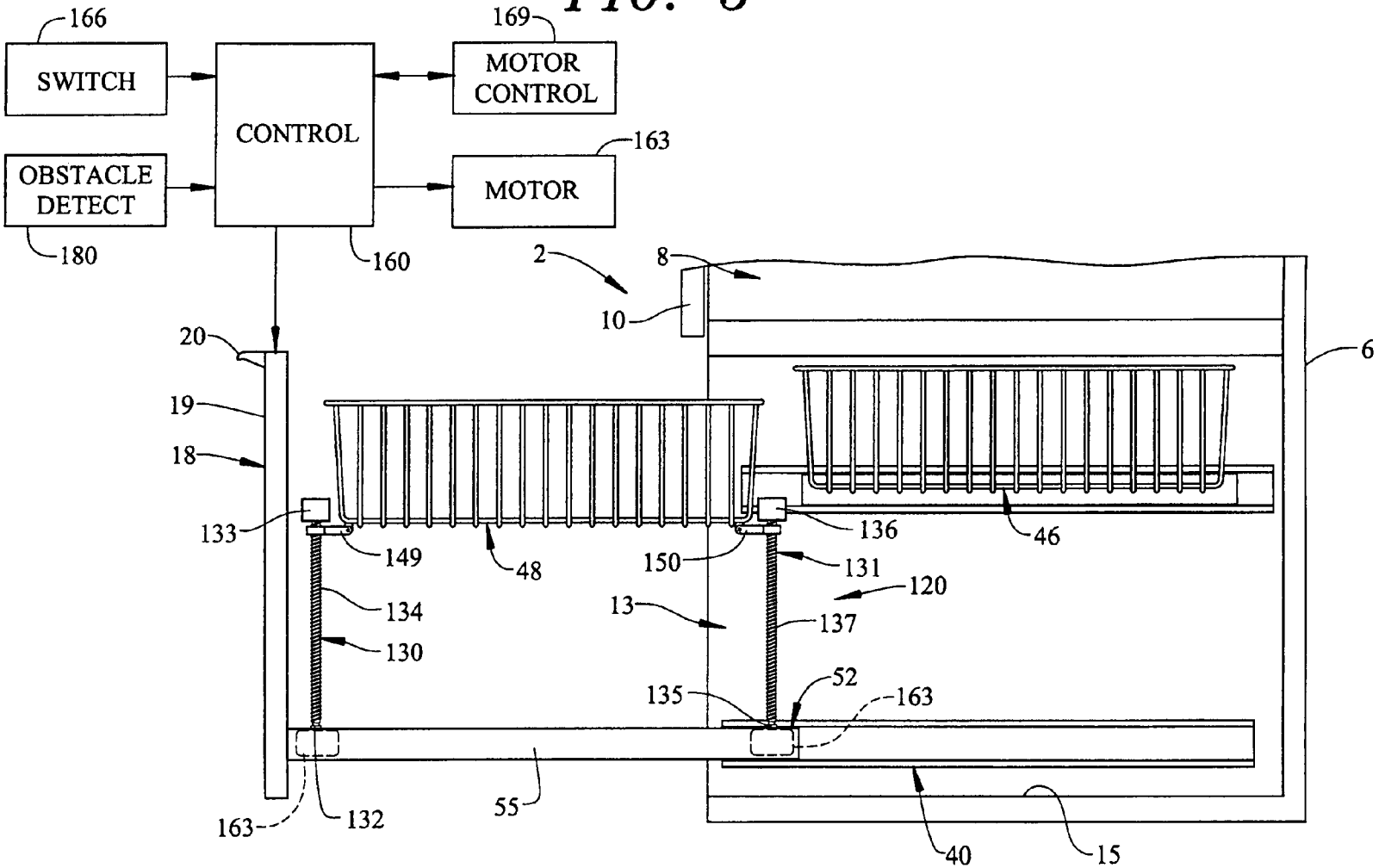
FIG. 5 is a cut-away side view of the refrigerator of FIG. 4 illustrating the freezer basket in a second or raised position.

Reference will now be made to FIGS. 4 and 5 in describing a lifting mechanism 120 constructed in accordance with a second embodiment of the present invention. As shown, lifting mechanism 120 includes a plurality of lifting members, two of which are indicated at 130 and 131 shown arranged along side portion 54 of basket support wall 52. In accordance with the embodiment shown, lifting member 130 includes a first end portion 132 which is mounted to basket support wall 52 and extends upward to a second end portion 133 through an intermediate portion 134. Likewise, lifting member 131 includes a first end portion 135 mounted to basket support wall 52 and extends upward to a second end portion 136 through an intermediate portion 137.

In accordance with the invention, intermediate portions 134 and 137 are threaded so that lifting members 130 and 131 actually constitute part of a worm screw mechanism that will be detailed more fully below. At this point, it should be understood that a second pair of lifting members (not shown) are arranged on opposing side portion 55. In any event, lower basket 48 is operatively connected to lifting members 130 and 131 through a pair of carrier members 149 and 150. As shown, carrier members 149 and 150 are secured to lower edge portions (not separately labeled) of lower basket 48. Each carrier member 149, 150 engages with a corresponding intermediate portion 134 and 137 of a respective lifting member 130, 131. That is to say, carrier members 149 and 150 include internally threaded portions (not shown) that cooperate with threads on intermediate portions 134 and 137.

In accordance with the embodiment shown, lifting mechanism 120 is operated through a control 160 that is operatively connected to a motor 163 and a switch 166. As shown, motor 163 is located in basket support wall 52. Alternatively, motor 163 could be provided at second end portions 133 and 136 of lifting members 130 and 131 respectively. In any case, switch 166 is preferably a non-latching electrical user input switch located on a top inner lip portion (not separately labeled) of freezer compartment door 18. Switch 166, when activated, signals a motor control 169 to operate motor 163 in a manner so as to raise or lower basket 48. Preferably, when activated, switch 166 will cause motor 163 to raise basket 48 to a height corresponding to that of upper basket 46 as represented in FIG. 5. In a preferred form of the invention, motor 163 will actually cause lower basket 48 to transition between raised and lowered positions in approximately 3 seconds. In any case, motor control 169 can signal motor 163 to operate in either a forward or reverse direction depending on a particular position of switch 166. That is, depending upon the position of switch 166, motor 163 rotates lifting members 130 and 131 to cause carrier members 149 and 150 to travel along intermediate portions 134 and 137 thereby shifting lower basket 48 between raised and lowered positions.

In accordance with one aspect of the present embodiment, lifting mechanism 120 is provided with an obstacle detection sensor 180 that determines whether a travel path is clear, thereby allowing lower basket 48 to be raised. More specifically, obstacle detection sensor 180, which takes the form of an IR sensor, current sensor, microswitch or the like, ensures that upper basket 46 is located within freezer compartment 13 so as to not interfere with the operation of lower basket 48 and/or that lower basket 48 is not overfilled with items that could limit the vertical displacement.

Figure 6:
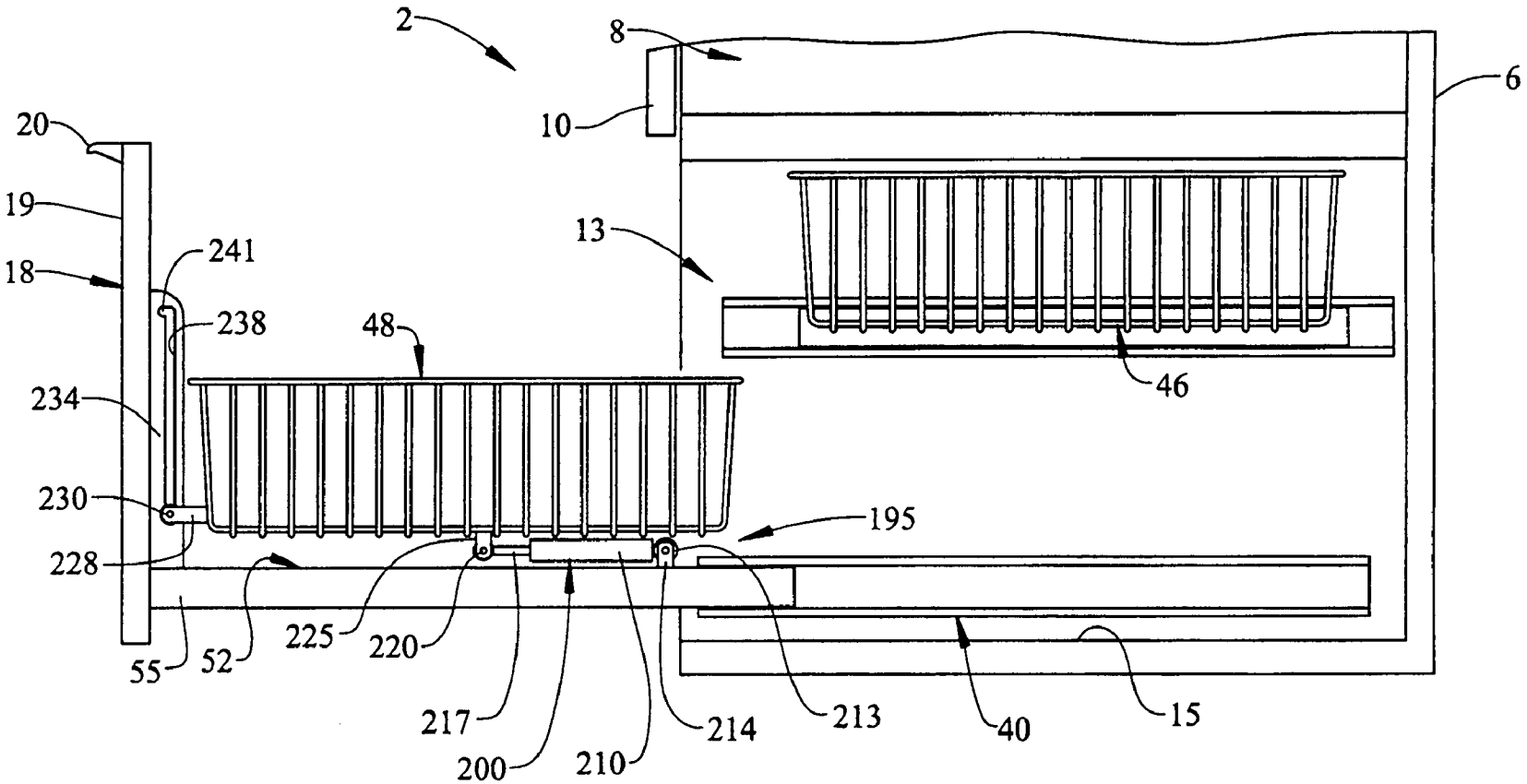
FIG. 6 is a cut-away side view of a refrigerator incorporating an elevating freezer basket constructed in accordance with a third embodiment of the present invention, with the freezer basket shown in a first or lowered position.
Figure 7:
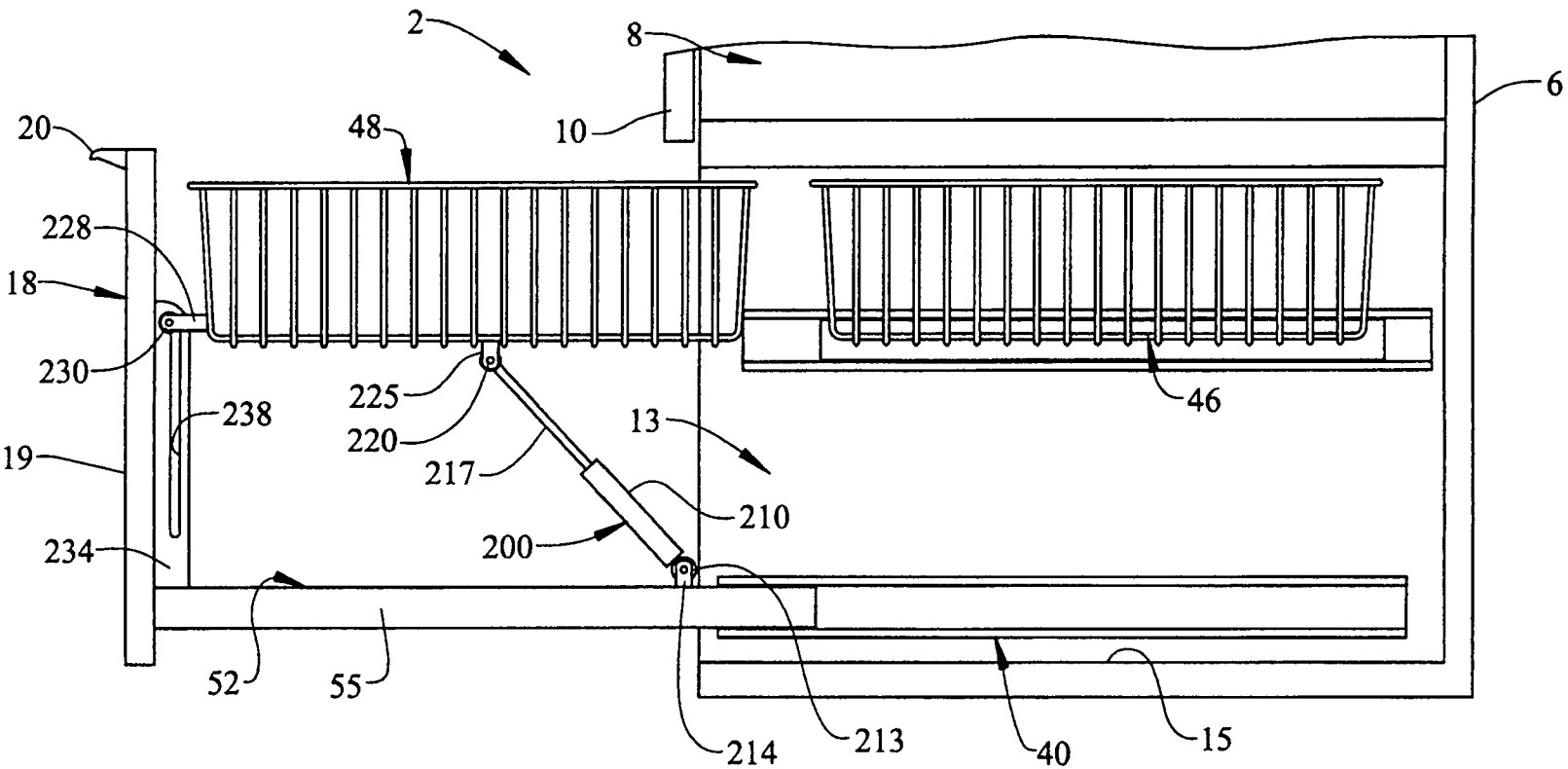
FIG. 7 is a cut-away side view of the refrigerator of FIG. 6 illustrating the freezer basket in a second or raised position.

Reference will now be made to FIGS. 6 and 7 in describing a lifting mechanism 195 constructed in accordance with a third embodiment of the present invention. As shown, a pneumatic lifting mechanism 195 includes a lifting member 200 that includes a cylinder portion 210 having a terminal end portion 213. Terminal end portion 213 is pivotally connected to a bracket 214 provided on basket support wall 52. Lifting member 200 also includes a piston or plunger 217 that retractably extends from within cylinder portion 210. Plunger 217 is provided with an end portion 220 that is pivotally connected to a mounting element 225 provided on lower basket 48. Mounting element 225 preferably extends substantially perpendicularly downward from a bottom wall (not separately labeled) of lower basket 48. A second bracket 228 projects from a front wall portion (not separately labeled) of lower basket 48 and includes a guide member 230 in the form of a pin or roller. Guide member 230 transitions within a guide element 234 when lower basket 48 transitions between a lowered position, as represented in FIG. 6, and a raised position, as represented in FIG. 7. More specifically, guide element 234 includes a longitudinally extending slot 238 that receives guide member 230 and terminates at an upper portion (not separately labeled) in a notch 241.

With this arrangement, a consumer need simply grasp lower basket 48 and pull upward, causing guide member 230 to travel upward along slot 238. At the same time, lifting mechanism 195 provides an assist to the consumer in raising lower basket 48. That is, as lower basket 48 is raised, compressed gas contained within cylinder portion 216 expands, forcing plunger 217 outward. As plunger 217 moves outward, a force is applied to lower basket 48 assisting the consumer. Once lower basket 48 is in the raised position, guide member 230 nests within notch 241 preventing lower basket 48 from inadvertently shifting.

When the consumer moves lower basket 48 to the lowered position, plunger 217 shifting in cylinder portion 216 acts as a damper, preventing lower basket 48 from slamming against basket support wall 52. More specifically, as lower basket 48 shifts downward, the compressed gas prevents plunger 217 from quickly retracting into cylinder portion 210. At this point, it should be understood that various other mechanisms, such as springs or cam operated linkages, could also be employed to soften or otherwise slow the transition from the raised position to the lowered position. For that matter, any form of damper can be incorporated into the first embodiment of the present invention to prevent lower basket 48 from rapidly shifting from the raised position to the lower position, thereby slamming into basket support wall 52.

With any of the above arrangements, a consumer is provided with enhanced access to a lower freezer basket. That is, it should be understood that the present invention provides for a convenient means of accessing a lower basket in a bottom mount freezer compartment so as to alleviate the need for a consumer to bend over when accessing items stored in the lower freezer basket. Although described with reference to preferred embodiments of the present invention, it should be understood that the lifting mechanisms described are but three examples of mechanisms that can be employed to raise the freezer basket from its lowered position to its raised position and numerous other mechanisms can also be employed. Also, it should be understood that the present invention could operate to automatically raise lower basket 48 upon opening freezer door 18. That is, when a consumer opens freezer door 18, basket 48 would automatically raise to a position corresponding to that of upper basket 46. Of course, with this arrangement, an obstacle detection sensor must be employed to ensure that the lifting mechanism does not operate in the event that there is something blocking the travel path of basket 48. In any case, the invention is only to be limited to be limited by the scope of the following claims.

We claim:

1. A refrigerator comprising:

a cabinet;

a liner arranged within the cabinet, said liner defining a fresh food compartment arranged within the cabinet;

a freezer compartment arranged within the cabinet, said freezer compartment being positioned below the fresh food compartment;

a fresh food door movably mounted relative to the cabinet for selectively providing access to the fresh food compartment;

a freezer door shiftably mounted relative to the cabinet for selectively providing access to the freezer compartment, the freezer door including a main portion and a basket support wall, said basket wall projecting from the main portion;

a freezer basket attached to the freezer door for concurrent sliding movement relative to the cabinet; and a lifting mechanism coupled to the freezer basket and including at least one lifting member arranged between the basket support wall and the freezer basket, said lifting mechanism being selectively employed to shift the freezer basket from a first or lowered position to a second or raised position, upon opening of the freezer door, to facilitate removal of items from the freezer basket, wherein the at least one lifting member includes a cylinder portion and a plunger portion, said cylinder portion being pivotally mounted to the basket support wall, with the plunger portion being pivotally attached to the freezer basket, said plunger portion extending and retracting relative to the cylinder portion upon shifting of the freezer basket between the first and second positions.

2. The refrigerator according to claim 1, wherein the lifting mechanism includes a guide element mounted to the main portion of the freezer drawer, said guide element having a longitudinally extending slot which terminates, at an upper end portion, in a notch.

3. The refrigerator according to claim 2, wherein the lifting mechanism includes a guide member supported by the freezer basket, said guide member being adapted to travel in the slot as the freezer basket transitions between the first and second positions.

4. The refrigerator according to claim 3, wherein the guide member is adapted to rest within the notch when the freezer basket is in the raised position.

5. A refrigerator comprising:

a cabinet;

a fresh food compartment arranged within the cabinet;

a freezer compartment arranged within the cabinet, said freezer compartment being positioned below the fresh food compartment;

a fresh food door movably mounted relative to the cabinet for selectively providing access to the fresh food compartment;

a freezer door shiftably mounted relative to the cabinet for selectively providing access to the freezer compartment, the freezer door including a main portion and a basket support wall, said basket support wall projecting from the main portion;

a freezer basket attached to the freezer door for concurrent sliding movement relative to the cabinet; and means for shifting the freezer basket between a first or lowered position and a second or raised position, upon opening of the freezer door, to facilitate insertion and removal of items from the freezer basket, the means for shifting including at least one lifting member arranged between the basket support wall and the freezer basket, wherein the at least one lifting member includes a cylinder portion and a plunger portion, said cylinder portion being pivotally mounted to the basket support wall, with the plunger portion being pivotally attached to the freezer basket, said plunger portion extending and retracting relative to the cylinder portion upon shifting of the freezer basket between the first and second positions.

6. The refrigerator according to claim 5, wherein the means for shifting includes a guide element mounted to the main portion of the freezer drawer, said guide element having a longitudinally extending slot which terminates, at an upper end portion, in a notch.

7. A method of accessing a freezer basket in a bottom mount refrigerator comprising:

opening a freezer door to expose a freezer compartment portion of the refrigerator;

simultaneous with the opening of the freezer door, shifting a freezer basket from a first position, wherein the freezer basket is located entirely within the freezer compartment, to a second position, wherein the freezer basket is located at least substantially outside of the freezer compartment; and operating a lifting mechanism to raise the freezer basket from a lowered position to a raised position to facility loading and unloading of items into the freezer basket, wherein operating the lifting mechanism includes pivoting a lifting member to shift the freezer basket between the lowered position and the raised position, and wherein the lifting member is pivoted over-center while shifting the freezer basket between the lowered position and the raised position.

* * * * *

UNITED STATES PATENT AND TRADEMARK OFFICE

CERTIFICATE OF CORRECTION

PATENT NO. : 7,628,461 B2
APPLICATION NO. : 11/489450
DATED : December 8, 2009
INVENTOR(S) : Carden et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 490 days.

Signed and Sealed this

Second Day of November, 2010

David J. Kappos

David J. Kappos
*Director of the United States Patent and Trademark Office*